US006866409B2

(12) United States Patent
Fields et al.

(10) Patent No.: US 6,866,409 B2
(45) Date of Patent: Mar. 15, 2005

(54) LIGHT BULB RETENTION ASSEMBLY

(75) Inventors: William Brent Fields, Bedford, IN (US); Sanders R. Brott, Seymour, IN (US)

(73) Assignee: Valeo Sylvania L.L.C., Seymour, IN (US)

( * ) Notice: Subject to any disclaimer, the term of this patent is extended or adjusted under 35 U.S.C. 154(b) by 0 days.

(21) Appl. No.: 10/462,147

(22) Filed: Jun. 16, 2003

(65) Prior Publication Data

US 2004/0252519 A1 Dec. 16, 2004

(51) Int. Cl.[7] ..... F21V 7/04

(52) U.S. Cl. ..... 362/549; 362/226; 362/429; 362/519; 362/523

(58) Field of Search ..... 362/523, 226, 362/364, 368, 429, 457, 519, 546, 549

(56) References Cited

U.S. PATENT DOCUMENTS 3,621,232 A * 11/1971 Hough et al. ..... 362/548
4,443,832 A * 4/1984 Kanamori et al. ..... 362/84
4,822,302 A * 4/1989 Dorleans ..... 439/544
5,516,245 A * 5/1996 Cassidy ..... 410/101
5,895,113 A * 4/1999 Ozaki et al. ..... 362/546
6,698,913 B2 * 3/2004 Yamamoto ..... 362/548

* cited by examiner

*Primary Examiner*—John Anthony Ward
(74) *Attorney, Agent, or Firm*—William E. Meyer

(57) ABSTRACT

A light bulb retention assembly for an automobile headlight includes an socket with an opening adapted to receive a light bulb, plural holes in the socket and around the opening that each have an end surface with an upper step and a lower step, plural pins that are each in a respective one of the holes, where each of the pins has a head with a first underside part that bears against the upper step and a second underside part that is separated from the lower step by a gap, and a lock ring having plural latching parts that each rotationally fit into a respective gap. The socket has a sealing edge and the plural latching parts mate with the sealing edge to hold a seal therebetween.

20 Claims, 3 Drawing Sheets

LIGHT BULB RETENTION ASSEMBLY

BACKGROUND OF THE INVENTION

The present invention is directed to a light bulb retention assembly, and more specifically to a retention assembly for holding a light bulb in an automobile headlight.

A light bulb, such as a light capsule for an automobile headlight, is typically inserted axially (without rotation) into a socket from the rear, the front of the headlight and socket being shielded by a protective lens cover. A seal may be attached to the periphery of a rear part of the socket. The socket has axially aligned and radially inward projections that mate with slots in the base of the bulb to prevent rotation of the bulb. The inserted bulb is held axially with a lock ring that is rotated into a holding position on the rear of the socket. The lock ring is held in position by rotationally mating retention surfaces on the lock ring with respective retention crevices on the socket.

The retention crevices for holding the lock ring can be formed in various ways, each of which presents problems during the manufacture of the assembly. For example, the mold for the socket (that may be part of a headlight reflector mold) may include slides or lifters formed by secondary molding actions. Since headlight reflectors are molded from high temperature polyester material, the molding process is not conducive to secondary molding actions because of the high molding temperatures and material flash problems. Further, molds that incorporate secondary molding actions are more expensive to build and maintain.

Another way to form the retention crevices for holding the lock ring has been to mill grooves or slots into the sockets. However, this creates a substantial dust problem that can degrade optical performance, even if steps are taken to reduce the dust. Further, the dust can cause health problems if inhaled and special care must be taken to ensure environmental quality.

A solution to the problems with secondary molding actions and milling has been to attach plates to the socket to create the retention crevices. However, the plates increase cost, must be attached with specific fasteners that mate with the plates, and require space that must be made available.

A further solution has been to use screws to define the retention crevices. The screws are spaced from the surface of the socket and the lock ring has a latching surface that fits beneath heads of the screws. The screws may also be used to hold the seal on the periphery of the socket. This arrangement is illustrated in FIG. 1 that is a rear view of prior art light bulb retention assembly. A light capsule 10 for an automobile headlight is inserted axially into a socket 12 and a seal 14 is attached to a periphery of a rear of the socket. Capsule 10 is held axially with a lock ring 16 that is rotated into a holding position on the rear of the socket. Lock ring inward projections 17 hold an edge of capsule 10. Lock ring 16 is held in position by rotationally mating latching surfaces 18 on the lock ring with respective retention crevices formed beneath screws 20 inserted into the socket. Screws 20 overlap an interior edge of seal 14. However, manufacture of this assembly requires tightening of the screws after placement of the seal. Further, the screws grip only small parts of the seal and can damage these small parts of the seal if too much pressure is applied by overtightening the screws.

SUMMARY OF THE INVENTION

An object of the present invention is to provide a novel light bulb retention assembly that avoids the problems of prior art.

A further object of the present invention is to provide a novel light capsule retention assembly for an automobile headlight in which the light capsule fits axially into a socket, a lock ring holds the light bulb in the socket, retention crevices formed beneath heads of retaining pins hold the lock ring in place, and the lock ring mates with the socket to hold a seal there between.

A yet further object of the present invention is to provide a novel light bulb retention assembly that includes an socket with an opening adapted to receive a light bulb, plural holes in the socket and around the opening that each have an end surface with upper and lower steps, plural pins that are each in a respective one of the holes, where each of the pins has an overhanging head with a first underside part that bears against the upper step and a second underside part that is separated from the lower step by a gap that is radially outward from the upper step, and a lock ring having plural latching parts that each rotationally fit into a respective gap and engage a seal around the socket.

Another object of the present invention is to provide a novel light bulb retention assembly for an automobile headlight that includes a socket surrounding an opening adapted to receive a light bulb in a first direction, where the socket has plural pedestals that are spaced around the opening and each of the pedestals extends in a second direction opposite the first direction to a stepped top surface with upper and lower steps, and plural retainers that each extend into a respective pedestal and have a head with a first underside part that bears against the upper step and a second underside part that is spaced from the lower step to define a radially outward gap for receiving a lock ring latching part, where the latching part also engages a periphery of the socket to hold a seal in place.

DESCRIPTION OF PREFERRED EMBODIMENTS

Figure 1:
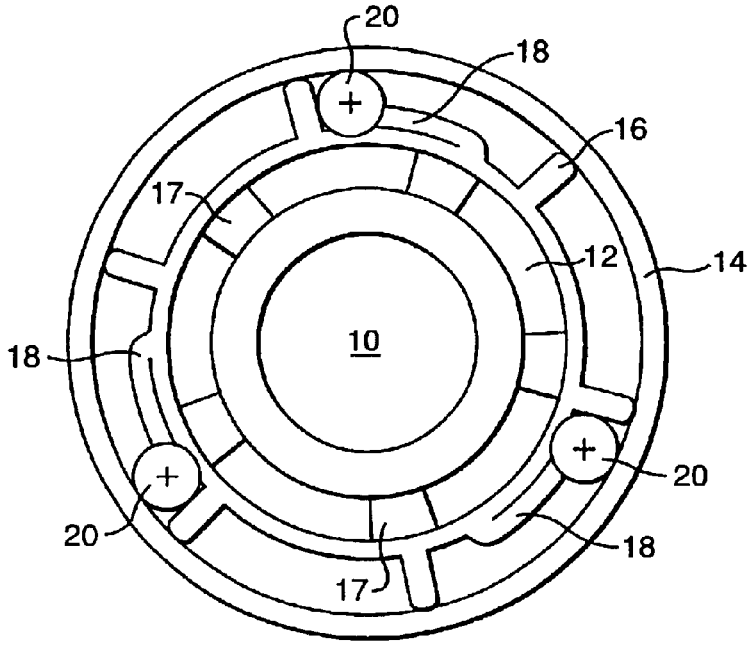
FIG. 1 (PRIOR ART)
FIG. 1 is a rear view of a prior art light bulb retention assembly.
Figure 2:
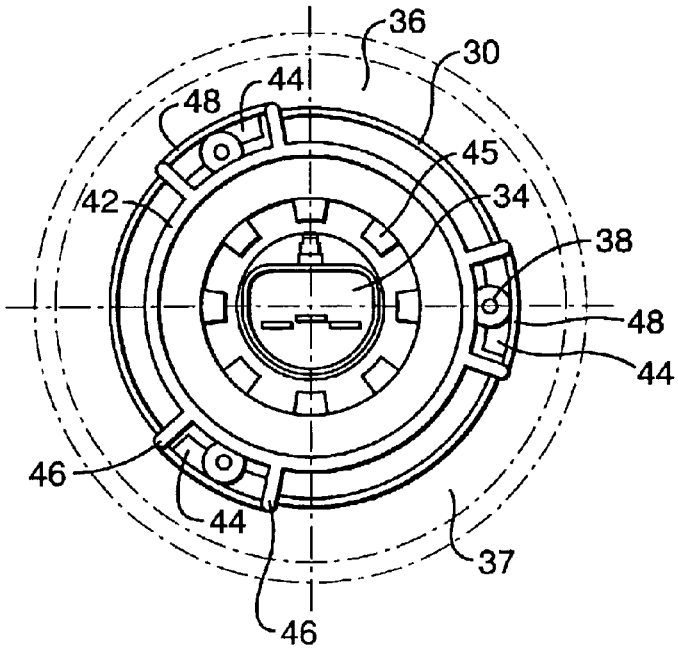
FIG. 2 is a rear view of an embodiment of the present invention.
Figure 3:
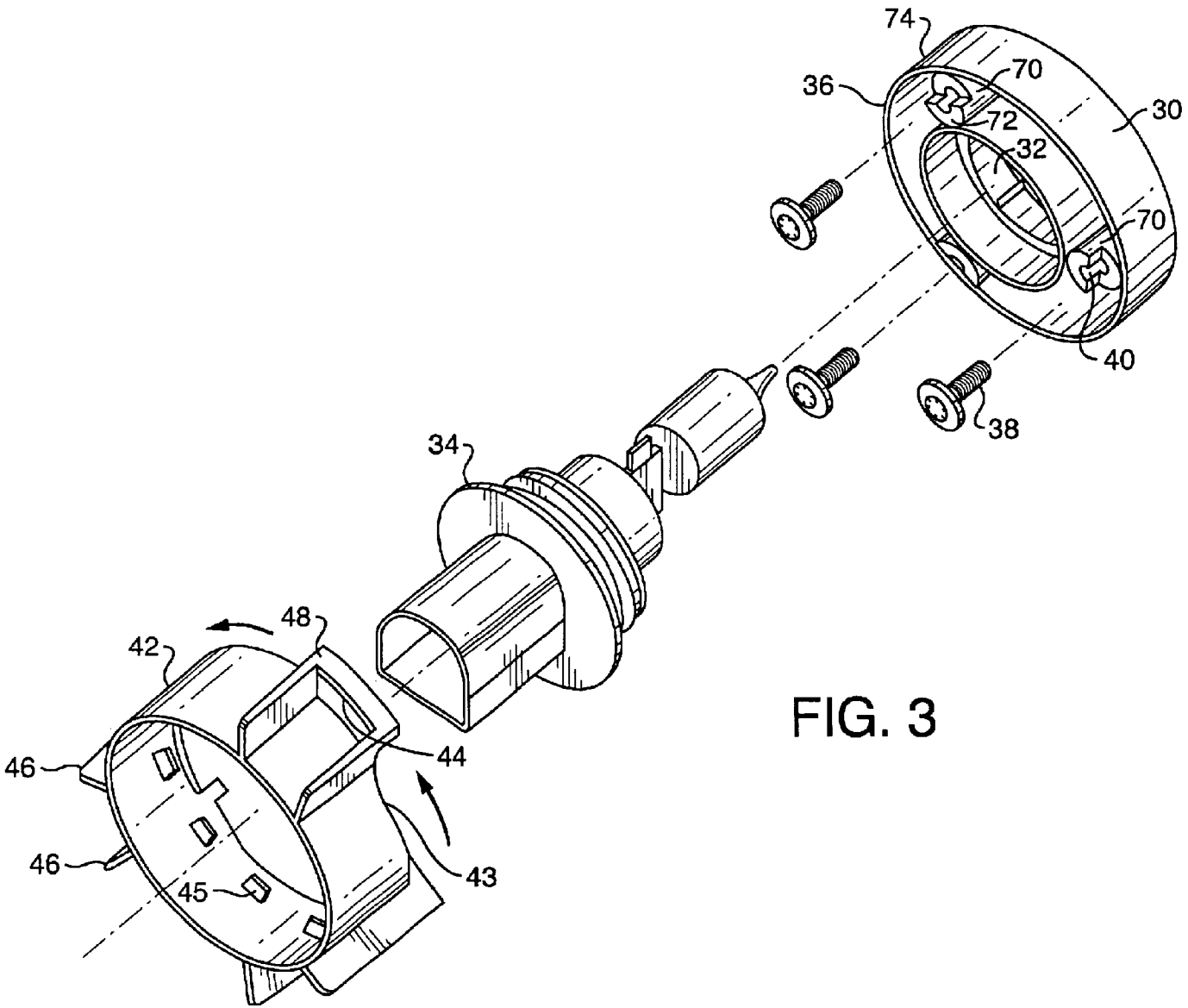
FIG. 3 is an exploded view of the embodiment of FIG. 2.

With reference now to FIGS. 2 and 3, an embodiment of the light bulb retention assembly of the present invention includes a socket 30 with an opening 32 arranged and adapted to axially receive a suitable light bulb 34. Socket 30 has a lip (or edge or part) 36 that is arranged and adapted to receive a seal 37 (shown in dashed lines in FIG. 2 and in cross section in FIG. 5). Retaining pins 38 in the socket are spaced from a surface of socket 30 so to define retention crevices 40. A lock ring 42 holds light bulb 34 in socket 30 and has latching surfaces 44 that rotationally mate with respective ones of the retention crevices 40 to hold the lock ring 42 on the socket 30. The latching surfaces 44 may mate with the lip 36 so as to overlap seal 37 therebetween. Inward projections 45 overlap edges of light bulb 34 to hold light bulb 34 in opening 32.

Lock ring 42 may include plural pairs of two radially outward projections 46, where outer edges of the radially outward projections 46 in each pair are attached to each other with a fence 48 to which a respective one of the latching surfaces 44 is inwardly attached. Fence 48 may mate with the lip 36 (instead or, in addition to, latching surfaces 44) so as to overlap seal 37 therebetween.

In operation, light bulb 34 is axially inserted into opening 32. Lock ring 42 is positioned over light bulb 34 onto socket 30 and rotated so that latching surfaces 44 mate with retention crevices 40 beneath retaining pins 38. In this position, inward projections 45 of lock ring 42 hold light bulb 34 in place and frictional engagement of latching surfaces 44 with retaining pins 38 holds lock ring 42 in place on socket 30. Retaining pins 38 may be inserted a defined amount and do not require tightening after placement of the seal or lock ring. This facilitates manufacturing of the assembly. Further, the latching surfaces or fences grip a wide part of the seal and thereby avoid damage to the seal that could have been caused by overtightening the screws in the prior art.

Figure 4:
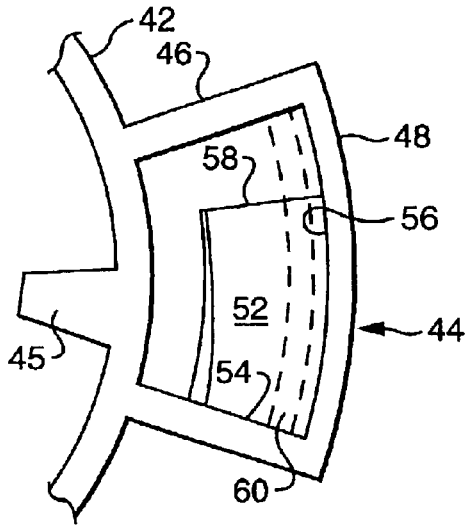
FIG. 4 is a partial view of an embodiment of the lock ring of the present invention illustrating the latching face.

With reference now to FIG. 4, latching surface 44 may be or include a ramp 52 with an elevated end 54 attached to a radial side of one of outward projections 46, an outer edge 56 attached to fence 48, and a lower end 58 that is unattached so as to slideably receive an underside of a respective one of retaining pins 38 on ramp 52. Movement of the retaining pin up ramp 52 during rotation of lock ring 42 urges lock ring 42 into tight contact with socket 30 and urges light bulb 34 into opening 32. An underside of latching surface 44, fence 48 and/or outwards projections 46 may be flat or have a ridge (an exemplary position being shown by dashed lines 60) that engages lip 36. A lower edge of lock ring 42 may be sloped in the vicinity of latching surface 44 (shown in FIG. 3 as slope 43) to make room for a top of a respective one of retaining pins 38 so as to permit movement of retaining pin 38 up ramp 52.

Figure 5:
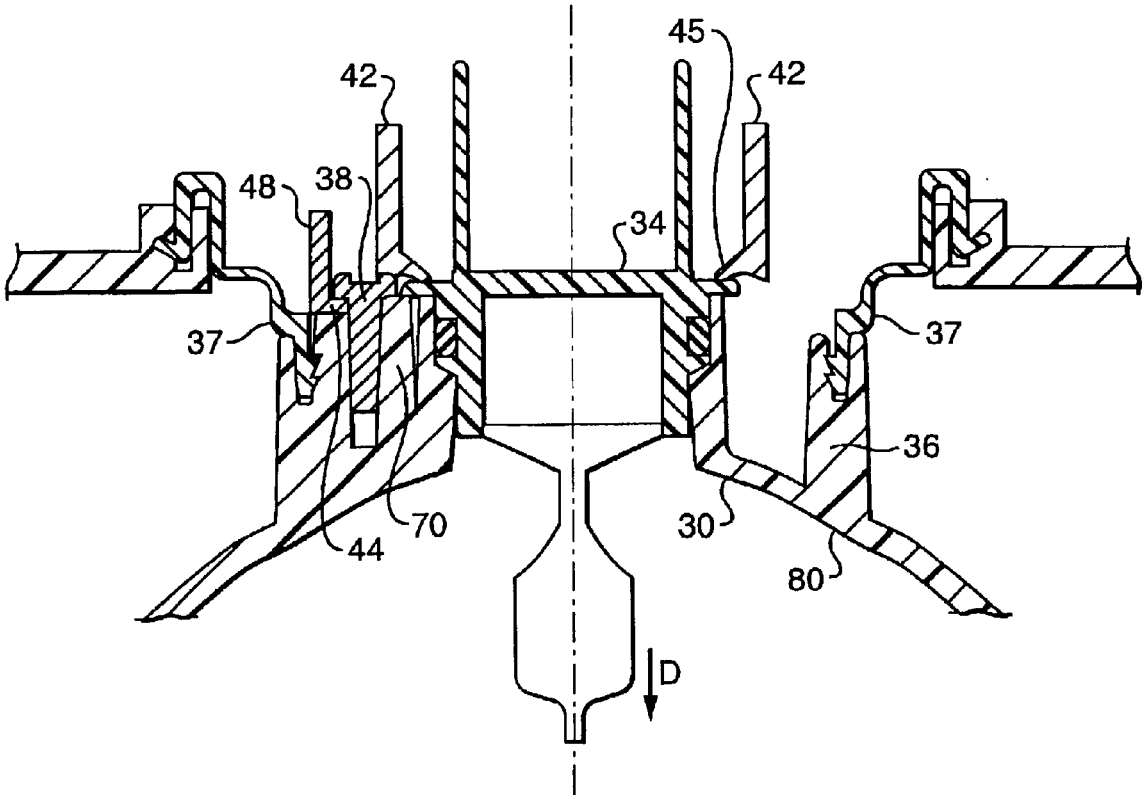
FIG. 5 is a cross sectional view of the embodiment of FIG. 2 showing the environment of the socket in greater detail.

With reference to FIGS. 3 and 5, socket 30 may have plural pedestals 70 that are spaced around opening 32, where each pedestal 70 extends in a direction opposite a bulb insertion direction D. Each pedestal 70 includes a stepped top surface with an upper step 72 and a lower step 74, where lower step 74 is radially outward from upper step 72. The riser between upper and lower steps 72–74 defines retention crevice 40. Edges of each upper step 72 (or the riser) may be generally rounded to conform with a different radius to opening 32. This is so the edges of the upper step 72 do not snag the lock ring 42. Pedestals 70 may be evenly spaced around a periphery of opening 32.

Retaining pins 38 may be screws or other fasteners that can be held in holes in pedestals 70. Each of retaining pins 38 may have a head with a first underside part that bears against upper step 72 and a second underside part that is separated from lower step 74 by retention crevice 40. Alternatively, retaining pins 38 may be in holes that are on a surface of socket 30 that has an upper step, where the surface of socket 30 defines the lower step (that is, without a distinguishable pedestal).

As shown in FIG. 5, socket 30 may be integral with a reflector 80 or housing of an automobile headlamp assembly.

While embodiments of the present invention have been described in the foregoing specification and drawings, it is to be understood that the present invention is defined by the following claims when read in light of the specification and drawings.

We claim:

1. A light bulb retention assembly for an automobile headlight, comprising:

a socket with an opening arranged and adapted to axially receive a light bulb and a lip arranged and adapted to receive a seal radially extended from an edge;

retaining pins in said socket spaced from a surface of said socket so as to define retention crevices; and an annular lock ring that holds the light bulb in the socket and that has latching surfaces that rotationally mate with respective ones of the retention crevices to hold the lock ring on the socket, said lock ring overlapping said lip with the seal held in compression intermediate the lip and the lock ring.

2. The assembly of claim 1, wherein said lock ring further comprises plural pairs of two radially outward projections, wherein outer edges of said two radially outward projections in each of said pairs are attached to each other with a fence to which a respective one of said latching surfaces is inwardly attached.

3. The assembly of claim 2, wherein said latching surface is a ramp with an elevated end attached to a radial side of one of said outward projections, an outer edge attached to said fence, and a lower end that is unattached so as to slideably receive an underside of a respective one of said retaining pins on said ramp.

4. The assembly of claim 1, wherein said socket is adapted to receive a light bulb in a first direction, wherein said socket has plural pedestals that are spaced around said opening, each of said plural pedestals extending in a second direction opposite said first direction to a stepped top surface with an upper step and a lower step, said lower step being radially outward from said upper step.

5. The assembly of claim 1, wherein edges of each said upper step are conformed to be within a fixed radius of said opening.

6. A light bulb retention assembly, comprising:

an annular socket defining an opening arranged and adapted to receive a light bulb, said socket having plural holes therein that each have a top surface with an upper step and a riser separating said upper step from a lower step, said riser defining a gap that is radially outward from said upper step, said socket having a sealing edge;

plural fasteners that are each in a respective one of said holes, each of said fasteners having a head with a first underside part that bears against said upper step and a second underside part that is separated from said lower step by said gap; and a lock ring having plural latching parts that each fit into a respective said gap, each of said latching parts overlapping said sealing edge, and a radially extending seal held between the overlapping latching parts and the sealing edge.

7. The assembly of claim 6, wherein said holes are evenly spaced around a periphery of said opening.

8. The assembly of claim 6, wherein each said riser is generally conformed to be within a fixed radius of said opening.

9. The assembly of claim 6, wherein said opening has plural axially aligned, radially inward projections that are arranged and adapted to fit into corresponding slots in a light bulb inserted in said opening.

10. The assembly of claim 6, wherein said fasteners are screws.

11. A light bulb retention assembly, comprising:

an annular socket defining an opening arranged and adapted to receive a light bulb, said socket having plural holes therein that each have a top surface with an upper step and a riser separating said upper step from a lower step, said riser defining a gap that is radially outward from said upper step, said socket having a sealing edge;

plural fasteners that are each in a respective one of said holes, each of said fasteners having a head with a first underside part that bears against said upper step and a second underside part that is separated from said lower step by said gap; and a lock ring having plural latching parts that each fit into a respective said gap, each of said latching parts overlapping said sealing edge, wherein said lock ring further comprises plural pairs of two radially outward projections, wherein outer edges of said two radially outward projections in each of said pairs are attached to each other with a fence to which one of said latching parts is inwardly attached.

12. The assembly of claim 11, wherein each of said latching parts is a ramp with an elevated end attached to a radial side of one of said outward projections, an outer edge attached to said fence, and a lower end that is unattached so as to slideably receive said second underside part on said ramp.

13. A light bulb retention assembly, comprising:

a socket with an axially extended opening arranged and adapted to receive a light bulb and with an annular exterior lip that is arranged and adapted to receive a seal;

plural axially aligned pins around said opening that are coupled to said socket, each of said plural pins having an overhanging head portion with a first part that bears axially against said socket and a second part that is diametrically opposite and radially outward from said first part and that is axially offset from said socket by a gap; and a lock ring having an annular wall with plural radially inward projections that are arranged and adapted to hold a light bulb in said opening and plural pairs of two spaced-apart radially outward projections, in each of said pairs of two radially outward projections, outer edges of said two radially outward projections are attached to each other with a fence to which is attached an inwardly extended latching face that is rotationally mated with a respective said gap to attach said lock ring to said socket, there being a space between said annular wall and said latching face that receives a respective said first part of said overhanging head portion, and wherein at least one of said fence and an underside of said latching face mates with said annular lip of said socket for holding a seal therebetween.

14. The assembly of claim 13, wherein said pins are screws.

15. The assembly of claim 13, wherein said socket comprises plural axially aligned holes for receiving said pins, each of said holes having a stepped surface periphery that includes an upper step on which said first part bears and a riser that separates said upper step from a lower step and defines said gap.

16. The assembly of claim 15, wherein said holes are evenly spaced around a periphery of said opening.

17. The assembly of claim 13, further comprising an annular seal that is a flexible annular boot with an interior edge contacting said annular lip, and wherein one of said fence and an underside of said latching face holds said interior edge on said annular lip.

18. The assembly of claim 13, wherein said latching face is a ramp with an elevated end attached to a radial side of one of said outward projections and a lower end that is unattached so as to slideably receive said second part of said overhanging head portion on said ramp.

19. A light bulb retention assembly, comprising:

an annular socket surrounding an opening arranged and adapted to receive a light bulb in a first direction, said socket having plural pedestals that are spaced around said opening, each of said plural pedestals extending in a second direction opposite said first direction to a stepped top surface with an upper step and a lower step, said lower step being radially outward from said upper step, said socket having a peripheral part for receiving a seal;

plural retainers that each extend into said top surface of a respective one of said pedestals, each of said retainers having a head with a first underside part that bears against said upper step and a second underside part that is spaced from said lower step; and a lock ring having plural latching parts that each fit between a respective said lower step and a corresponding said second underside part, wherein a radially outward part of each of said latching parts is aligned with said peripheral part of said socket.

20. The assembly of claim 19, wherein said lock ring comprises plural pairs of two radially outward projections, wherein said two radially outward projections in each of said pairs are attached to each other with a respective one of said latching parts, and wherein each of said latching parts comprises a ramp with an elevated end attached to a radial side of one of said outward projections and a lower end that is unattached so as to slideably receive said second underside part on said ramp.

* * * * *